US006565311B2

(12) United States Patent
Oya et al.

(10) Patent No.: US 6,565,311 B2
(45) Date of Patent: May 20, 2003

(54) GAS TURBINE STEAM PASSAGE SEAL STRUCTURE BETWEEN BLADE RING AND STATIONARY BLADE

(75) Inventors: Takeaki Oya, Takasago (JP); Kazuharu Hirokawa, Takasago (JP); Tadateru Tanioka, Takasago (JP); Nobuhiro Kunitake, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/988,720

(22) Filed: Nov. 20, 2001

(65) Prior Publication Data

US 2002/0076319 A1 Jun. 20, 2002

(30) Foreign Application Priority Data

Nov. 21, 2000 (JP) ..... 2000-353944

(51) Int. Cl.[7] ..... F01D 9/06

(52) U.S. Cl. ..... 415/115; 415/96 A; 415/97 R

(58) Field of Search ..... 415/115, 114, 415/116; 416/96 R, 97 R, 96 A

(56) References Cited

U.S. PATENT DOCUMENTS 2,421,855 A * 6/1947 Soderberg
2,931,623 A * 4/1960 Hyde
3,370,830 A * 2/1968 Nickles et al.
3,471,126 A * 10/1969 Abild
3,767,322 A * 10/1973 Durgin et al. ..... 416/97
4,136,516 A * 1/1979 Corsmeier ..... 60/39.09
4,288,201 A * 9/1981 Wilson
5,217,347 A * 6/1993 Miraucourt et al. ..... 415/115
5,318,404 A 6/1994 Carreno et al.
5,984,637 A * 11/1999 Matsuo ..... 416/97 R
6,000,909 A * 12/1999 Hirokawa et al. ..... 416/96 R
6,398,486 B1 * 6/2002 Storey et al. ..... 415/115

FOREIGN PATENT DOCUMENTS

JP 11-30102 2/1999

* cited by examiner

*Primary Examiner*—Edward K. Look
*Assistant Examiner*—James M McAleenan
(74) *Attorney, Agent, or Firm*—Wenderoth, Lind & Ponack, L.L.P.

(57) ABSTRACT

Gas turbine steam passage seal structure between a blade ring and a stationary blade absorbs thermal deformation to prevent occurrence of minute gaps to thereby reduce leakage of steam as cooling medium. A blade ring steam passage hole, provided in the blade ring (10), has a stepped portion formed in a middle portion thereof. A stationary blade steam passage hole, provided in the stationary blade (50) so as to oppose the blade ring steam passage hole, has a stepped portion formed in an outer peripheral portion thereof. A cooling steam supply passage connection portion is constructed comprising a seal pipe (25) provided between the blade ring and stationary blade steam passage holes so as to communicate them with each other and a seal urging guide device (44, 47) provided at each of the stepped portions of the blade ring and stationary blade steam passage holes so as to effect a seal while fixedly supporting the seal pipe (25). Leakage of the steam is reduced, temperature lowering of combustion gas is prevented, drive force of a steam turbine is increased and the entire thermal efficiency of the combined cycle power plant can be enhanced.

13 Claims, 7 Drawing Sheets

GAS TURBINE STEAM PASSAGE SEAL STRUCTURE BETWEEN BLADE RING AND STATIONARY BLADE

BACKGROUND OF THE INVENTION

1. Field of the Invention

The present invention relates to a seal structure of a steam passage between a blade ring and a stationary blade of a steam cooled type gas turbine, that is so structured that cooling steam, flowing in a cooling steam supply passage and return passage, is prevented from leaking from a steam shield connection portion of the blade ring and a fitting portion of the stationary blade.

2. Description of the Prior Art

The recent combined cycle power plant (herein simply referred to as "the plant") is in the tendency that a gas turbine thereof is operated at a higher temperature for realizing a higher efficiency of the plant and, in order to improve the thermal efficiency, such a gas turbine as uses steam, instead of air, as cooling medium for cooling a gas turbine blade and the like is being developed.

In such a steam cooled type gas turbine, the steam for cooling the gas turbine blade and the like, flowing in a seal structure of a steam passage between a blade ring and a stationary blade (herein simply referred to as "the seal structure"), is not discharged into main flow gas as combustion gas but cooling heat of the gas turbine blade and the like is recovered into a steam turbine of the plant, thereby increasing output of the entire plant. Also, by suppressing blowing quantity of the cooling medium into the combustion gas that drives the gas turbine blade, temperature lowering of the combustion gas is prevented and the gas turbine efficiency is enhanced and thus the efficiency of the entire plant can be enhanced.

In the plant described above, the cooling steam used as the cooling medium is usually of a pressure higher than the atmospheric pressure and needs to be shielded against the atmospheric pressure to be supplied into the gas turbine interior.

Also, in order to enhance the output of the entire plant by recovering the cooling steam into the steam turbine, it is necessary to make cooling steam passages, provided in the outer and inner blade rings and the stationary blade of the gas turbine, in a closed form.

A prior art seal structure made in such a closed form will be described with reference to an example shown in FIG. 7. While this example has been originally designed to use compressed air as cooling medium, it is modified so as to use cooling steam for cooling the steam cooled type gas turbine.

As used herein, the term "outer, or inner, circumferential side" means the outer, or inner, circumferential side in a rotor radial direction of the gas turbine or, in other words, "the upper, or lower, side" as seen in the respective figures appended herein.

As shown in FIG. 7, in the prior art seal structure, cooling steam is supplied from outside (not shown) into a blade ring 10 to flow through a steam shield connection portion 21 and a blade ring cooling steam supply passage 30, that is provided in the blade ring 10, and cools the blade ring 10. Then, the cooling steam flows through a seal pipe 25 to enter a stationary blade 50. The seal pipe 25 is of a hollow cylindrical shape having at one end a flange portion 26 and is provided in a cooling steam supply passage connection portion between the blade ring cooling steam supply passage 30 and a stationary blade cooling steam supply passage 39, that is provided in the stationary blade 50. While flowing through the stationary blade cooling steam supply passage 39, the cooling steam cools the stationary blade 50 and, having been used for the cooling, it is recovered outside of the blade ring 10 through a cooling steam return passage (not shown), that is provided to pass through the blade ring 10.

When the cooling steam enters the steam shield connection portion 21, it is of a temperature of about 200 to 300° C. and when the cooling steam returns to the cooling steam return passage, it is heated to a temperature of about 500 to 600° C., that is elevated by cooling the blade ring 10 and the stationary blade 50.

Thus, in the portions through which the cooling steam flows, there are caused thermal deformations in the rotor axial, radial and circumferential directions by the heat of the steam and it is needed to provide there such a steam passage seal structure that is able to absorb the thermal deformations. That is, the prior art seal structure, as shown in FIG. 7, is made such that, in a fitting portion of the stationary blade 50 to the blade ring 10, the blade ring cooling steam supply passage 30 and the stationary blade cooling steam supply passage 39 are connected together at a shroud 42, that is provided around a periphery of the fitting portion of the stationary blade 50 and is fastened by a bolt 41. Thereby, a seal is effected at the flange portion 26 by a metal seal ring 70*a*', 70*b*' but, in this seal structure, there is still a problem that minute gaps arise in the cooling steam supply passage connection portion due to the thermal deformation to cause a steam leakage.

SUMMARY OF THE INVENTION

In order to solve the problem in the prior art to cause the steam leakage at the connection portion between the blade ring cooling steam supply passage and the stationary blade cooling steam supply passage, it is an object of the present invention to provide a seal structure of a cooling steam supply passage connection portion between a blade ring and a stationary blade of a steam cooled type gas turbine that is able to greatly enhance the sealing ability and to largely advance the realizability of a steam cooled blade ring and stationary blade. In addition to this, it is also an object of the present invention to provide a like seal structure of a cooling steam return passage provided in the blade ring and the stationary blade.

In order to achieve the mentioned objects, the present invention provides the means of the following inventions (1) to (13), wherein the inventions (2) to (13) are based on the invention (1), and functions and effects of the respective inventions (1) to (13) will be described in items (a) to (m).

(1) As a first one of the present invention, a gas turbine steam passage seal structure between a blade ring and a stationary blade, comprises: a blade ring steam passage hole provided in the blade ring so as to have its one end communicated with a steam passage chamber of the blade ring, the blade ring steam passage hole having a stepped portion formed in a middle portion thereof; a stationary blade steam passage hole provided in the stationary blade so as to oppose the other end of the blade ring steam passage hole, the stationary blade steam passage hole having a stepped portion formed in a stationary blade outer peripheral portion thereof; and a cooling steam supply passage connection portion constructed comprising a seal pipe of a hollow cylindrical shape provided between the blade ring steam passage hole and the stationary blade steam passage hole so as to communicate them with each other and a seal urging guide device provided at each of the stepped portions of the blade ring steam passage hole and the stationary blade steam passage hole so as to effect a seal of the cooling steam supply passage connection portion while fixedly supporting the seal pipe.

(a) By the above construction, even if the blade ring and the stationary blade make deformations by the heat of the steam, the steam passages in the cooling steam supply passage connection portion between the blade ring and the stationary blade have a flexibility to elongate and contract in the rotor axial, radial and circumferential directions. Thereby, the deformations due to the heat of the steam are absorbed and also steam leakage through minute gaps in the cooling steam supply passage connection portion can be prevented so that drive force of the steam turbine using the recovery steam may be increased. Also, temperature lowering of the combustion gas due to the inflow of the leaking steam is avoided so that drive force of the gas turbine may be increased and the thermal efficiency of the combined cycle power generation plant can be improved.

(2) As a second one of the present invention, in addition to the means of the gas turbine steam passage seal structure of the invention (1) that is applied to a cooling steam supply passage, the same seal structure is also applied to a cooling steam return passage.

(b) By this construction, the same function and effect as in the above item (a) can be obtained, the drive force of the steam turbine as well as the drive force of the gas turbine are further enhanced and the thermal efficiency of the combined cycle power generation plant can be further improved.

(3) As a third one of the present invention, in addition to the means of the gas turbine steam passage seal structure of the invention (1), a metal seal ring is interposed between the seal urging guide device and at least one of the stepped portions of the blade ring steam passage hole and the stationary blade steam passage hole.

(c) By this construction, the same function and effect as in the above item (a) can be obtained and also the deformation caused in the blade ring and stationary blade cooling steam supply passages due to the heat of the steam can be absorbed by the deformation of the metal seal ring. Thus, the gaps caused in the cooling steam supply passage connection portion between the blade ring steam passage hole and the stationary blade steam passage hole can be substantially eliminated and steam leakage from these gaps can be prevented.

(4) As a fourth one of the present invention, in addition to the means of the gas turbine steam passage seal structure of the invention (1), the seal pipe has its lower end provided with a flange portion and the flange portion is fixedly supported to the stepped portion of the stationary blade steam passage hole by an urging force of the seal urging guide device provided in the stationary blade steam passage hole.

(d) By this construction, the same function and effect as in the above item (a) can be obtained and also the flange portion of the lower end of the seal pipe forming the blade ring cooling steam supply passage is fixedly supported by the urging force of the seal urging guide device provided in the stationary blade steam passage hole. Thus, leakage of the steam through gaps that may be caused by the thermal deformation or vibration in the blade ring and the stationary blade can be prevented.

(5) As a fifth one of the present invention, in addition to the means of the gas turbine steam passage seal structure of the invention (4), a gland packing case is fitted into the blade ring steam passage hole and a gland packing is interposed between the seal pipe and the gland packing case.

(e) By this construction, the same function and effect as in the above item (d) can be obtained and also the upper end portion of the seal pipe is fixedly supported by the pressing force of the gland packing of the seal urging guide device provided in the blade ring steam passage hole. Thus, gaps that may be caused by the thermal deformation or vibration around the outer peripheral portion of the seal pipe can be eliminated and steam leakage through these gaps can be prevented.

(6) As a sixth one of the present invention, in addition to the means of the gas turbine steam passage seal structure of the invention (1), the cooling steam supply passage connection portion is constructed comprising a first seal pipe provided between the blade ring steam passage hole and the stationary blade steam passage hole so as to communicate them with each other, a second seal pipe and a third seal pipe both provided in the blade ring steam passage hole and a fourth seal pipe provided in the stationary blade steam passage hole. The first seal pipe has at its outer circumferential upper and lower surfaces swell portions, the swell portion on the upper side making a slidable contact with an inner circumferential surface of the second seal pipe, the swell portion on the lower side making a slidable contact with an inner circumferential surface of the fourth seal pipe. The second seal pipe has on its outer circumferential surface a projecting portion that abuts on the stepped portion of the blade ring steam passage hole. The third seal pipe is supported at its outer circumferential surface to the blade ring steam passage hole via a screw engagement and makes at its inner circumferential surface a slidable contact with an outer circumferential surface of the second seal pipe, and the fourth seal pipe has at its lower end a flange portion.

(f) By this construction, the same function and effect as in the above item (a) can be obtained. Moreover, the entire seal structure is so made that assembly and disassembly of the seal pipes and the surrounding members for ensuring the sealing may be done easily.

(7) As a seventh one of the present invention, in addition to the means of the gas turbine steam passage seal structure of the invention (6), the second seal pipe has its upper inner circumferential surface provided with a tapered projecting portion so that the first seal pipe at its swell portion on the upper side may abut on the tapered projecting portion to be prevented from moving more upwardly.

(g) By this construction, the same function and effect as in the above item (f) can be obtained. Moreover, the tapered projecting portion of the second seal pipe prevents the first seal pipe from moving more upwardly to slip off beyond the second seal pipe. Thus, sealing between the first and second seal pipes can be ensured. If a metal coating is applied to the contact surfaces between the first and second seal pipes, friction there can be lessened and a more smooth slidable contact can be realized.

(8) As an eighth one of the present invention, in addition to the means of the gas turbine steam passage seal structure of the invention (6), the seal urging guide device of the blade ring steam passage hole is formed comprising the projecting portion of the second seal pipe that abuts on the stepped portion of the blade ring steam passage hole and the third seal pipe that is supported to the blade ring steam passage hole via the screw engagement so as to generate an urging force to press the second seal pipe downwardly.

(h) By this construction, the same function and effect as in the above item (f) can be obtained. Moreover, the upper outer peripheral portion of the cooling steam supply passage connection portion can be sufficiently sealed by the-urging force of the seal urging guide device of the blade ring steam passage hole. Thus, even if there are caused the thermal deformation and vibration in the seal pipes and the surrounding members, gaps through which the steam leaks are not caused and leaking steam can be greatly reduced.

(9) As a ninth one of the present invention, in addition to the means of the gas turbine steam passage seal structure of the invention (6), the seal urging guide device of the stationary blade steam passage hole is formed comprising the fourth seal pipe having the flange portion and a screw member as an independent member that is supported at its outer circumferential surface to the stationary blade steam passage hole via a screw engagement so as to generate an urging force to press the fourth seal pipe downwardly and makes at its inner circumferential surface a slidable contact with an outer circumferential surface of the fourth seal pipe.

(i) By this construction, the same function and effect as in the above item (f) can be obtained. Moreover, the lower end portion of the cooling steam supply passage connection portion can be sufficiently sealed by the urging force of the seal urging guide device of the stationary blade steam passage hole. Thus, even if there are caused the thermal deformation and vibration in the seal pipes and the surrounding members, gaps through which the steam leaks are not caused and leaking steam can be greatly reduced.

(10) As a tenth one of the present invention, in addition to the means of the gas turbine steam passage seal structure of the invention (1), the cooling steam supply passage connection portion at its portion provided in the blade ring steam passage hole is constructed comprising a bellows member that is elongatable and contractible in the rotor radial direction and a control ring that is fitted into a recessed portion of an outer periphery of the bellows member so as to stably support the bellows member.

(j) By this construction, the same function and effect as in the above item (a) can be obtained. Moreover, the cooling steam supply passage connection portion comprises the bellows member that is elongatable and contractible in the rotor radial direction. Thus, in operation of the gas turbine, while the thermal deformations are caused in the rotor axial, radial and circumferential directions, the thermal deformations, especially the thermal deformation in the rotor radial direction, are sufficiently absorbed by the bellows member and the steam leakage can be prevented by the simple structure.

(11) As an eleventh one of the present invention, in addition to the means of the gas turbine steam passage seal structure of the invention (1), the cooling steam supply passage connection portion at its portion provided in the blade ring steam passage hole is constructed comprising seal pipes provided at upper and lower ends thereof and a bellows member, provided therebetween, that is elongatable and contractible in the rotor radial direction.

(k) By this construction, the same function and effect as in the above item (a) can be obtained. Moreover, the bellows member is provided in the cooling steam supply passage connection portion and the thermal deformations are sufficiently absorbed, like in the above item (j), and the steam leakage can be prevented by the simple structure.

(12) As a twelfth one of the present invention, in addition to the means of the gas turbine steam passage seal structure of the invention (1), the cooling steam supply passage connection portion is constructed comprising a seal pipe and a bellows member connected to each other, the bellows member being elongatable and contractible in the rotor radial direction.

(l) By this construction, the same function and effect as in the above item (a) can be obtained. Moreover, the bellows member is provided in the cooling steam supply passage connection portion and the thermal deformations are sufficiently absorbed, like in the above item (j), and the steam leakage can be prevented by the simple structure.

(13) As a thirteenth one of the present invention, in addition to the means of the gas turbine steam passage seal structure of the invention (1), the cooling steam supply passage connection portion is constructed comprising a plurality of seal pipes, a bellows member, that is elongatable and contractible in the rotor radial direction and is interposed between adjacent ones of the plurality of seal pipes and a bellows member, that is elongatable and contractible in the rotor axial direction and is interposed between other adjacent ones of the plurality of seal pipes.

(m) By this construction, the same function and effect as in the above item (a) can be obtained. Moreover, the two types of the bellows members, one being elongatable and contractible in the rotor radial direction and the other being elongatable and contractible in the rotor axial direction, are provided in the cooling steam supply passage connection portion. Thus, in operation of the gas turbine, while the thermal deformations are caused in the rotor axial, radial and circumferential directions, the thermal deformations in every direction can be sufficiently absorbed by the two types of the bellows members and the steam leakage can be prevented more securely.

DESCRIPTION OF THE PREFERRED EMBODIMENTS

Figure 7:
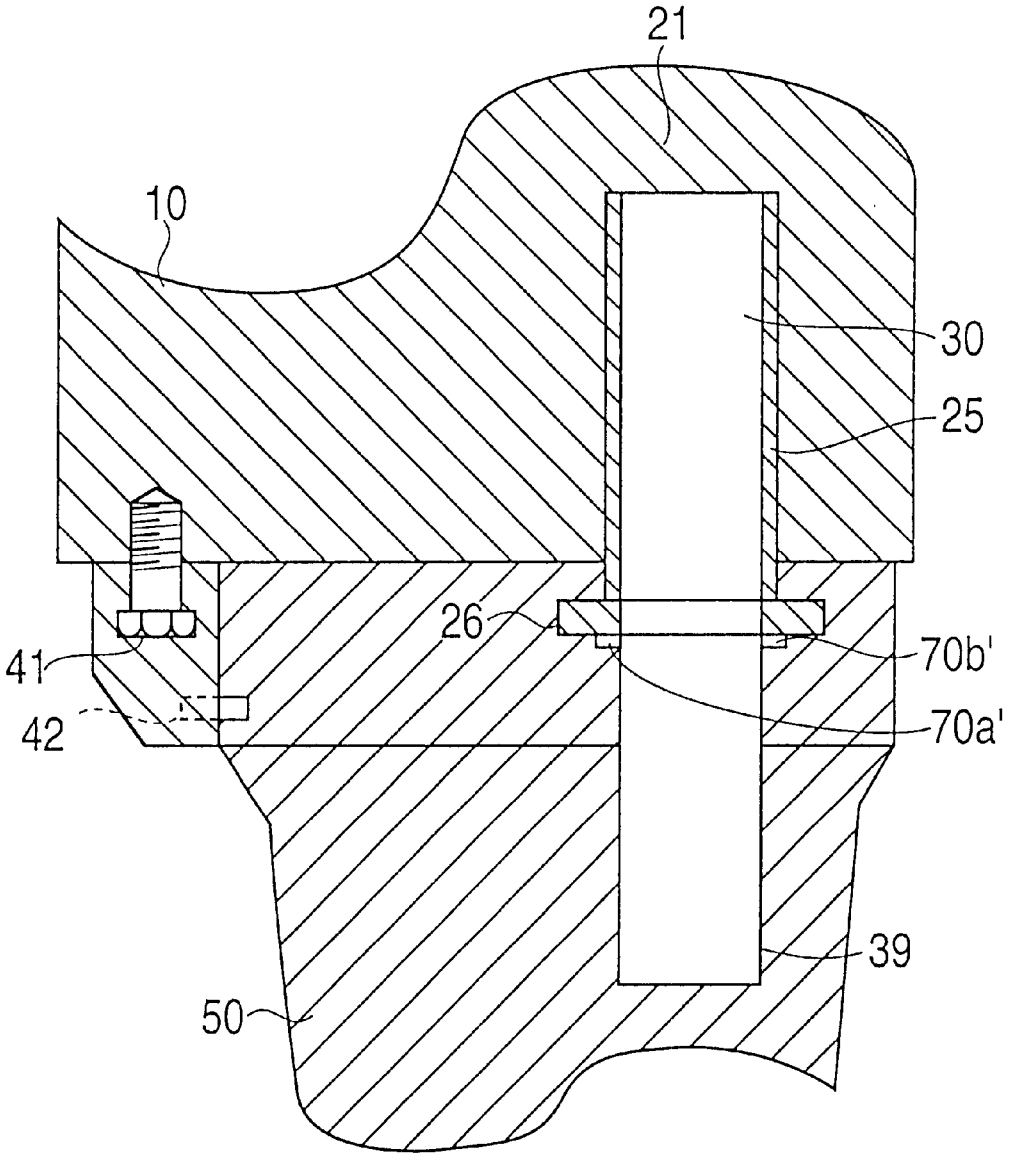
FIG. 7 (PRIOR ART)
FIG. 7 is a view, in the same concept as FIG. 1, of a prior art gas turbine.

Herebelow, embodiments according to the present invention will be described with reference to figures. It is to be noted that, in the figures, the same or similar parts or components as those shown in FIG. 7 are designated with the same reference numerals and description thereon will be omitted.

Figure 1:
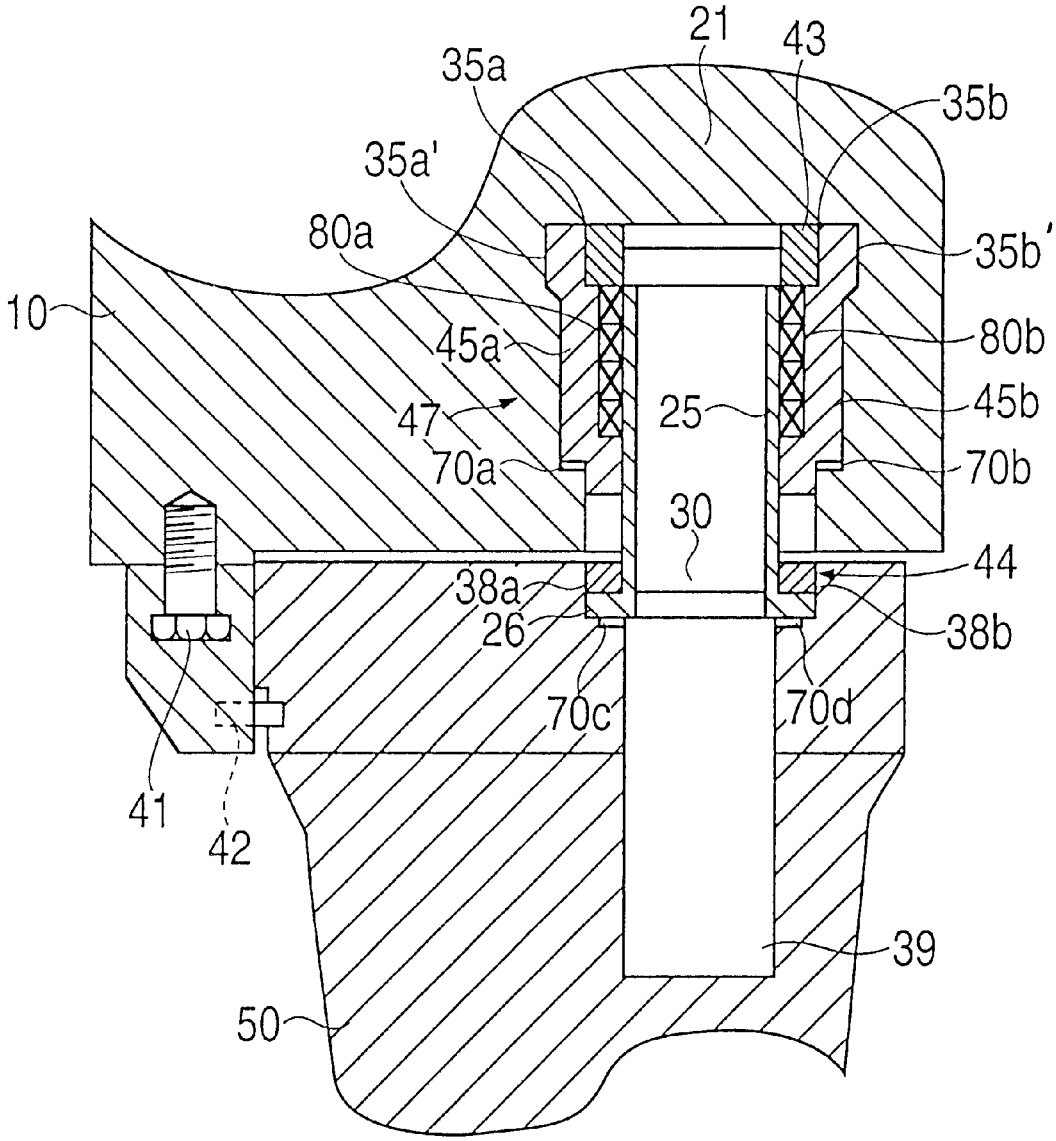
FIG. 1 is an explanatory cross sectional view showing a seal structure of a cooling steam supply passage connection portion between a blade ring cooling steam supply passage and a stationary blade cooling steam supply passage in a gas turbine of a first embodiment according to the present invention.

FIG. 1 is an explanatory cross sectional view showing a seal structure of a cooling steam supply passage connection portion between a blade ring cooling steam supply passage and a stationary blade cooling system supply passage in a gas turbine of a first embodiment according to the present invention.

In FIG. 1, a blade ring cooling steam supply passage 30 has its one end inserted into a blade ring steam passage hole provided on the inner circumferential side of the steam shield connection portion 21, that passes through the blade ring 10 so as to communicate with a steam passage chamber (not shown) provided in the blade ring 10, and has the other end inserted into a stationary blade steam passage hole provided on the outer circumferential side of a stationary blade cooling steam supply passage 39, that is provided in the stationary blade 50. A flange portion 26 of a seal pipe 25, that is of a hollow cylindrical shape, is interposed between the blade ring cooling steam supply passage 30 and the stationary blade cooling steam supply passage 39.

It is to be noted that a cooling steam return passage (not shown) provided in the blade ring 10 and the stationary blade 50 is made in the substantially same structure as the blade ring and stationary blade cooling steam supply passages 30, 39 of the present embodiment and description thereon will be represented by the description on the example of the blade ring and stationary blade cooling steam supply passages 30, 39.

As shown in FIG. 1, the blade ring cooling steam supply passage 30 extends between the flange portion 26 of the seal pipe 25 inserted into the portion on the outer circumferential side of the stationary blade 50 and the portion inserted into the steam shield connection portion 21 of the blade ring 10. In the portion inserted into the steam shield connection portion 21 of the blade ring cooling steam supply passage 30, there is provided a blade ring seal urging guide device 47. The blade ring seal urging guide device 47 comprises a gland packing 80*a*, 80*b* surrounding the seal pipe 25, a gland packing case 45*a*, 45*b* supported to the blade ring 10 via a screw engagement 35*a*', 35*b*' for supporting the gland packing 80*a*, 80*b*, an urging bolt 43 supported to the gland packing case 45*a*, 45*b* via a screw engagement 35*a*, 35*b* for urging the gland packing 80*a*, 80*b* and a metal seal ring 70*a*, 70*b* interposed between stepped portions provided in an outer peripheral middle portion of the gland packing case 45*a*, 45*b* and in an inner peripheral middle portion of the blade ring steam passage hole into which the gland packing case 45*a*, 45*b* is inserted. By this seal structure, the steam in the cooling steam supply passage connection portion of the blade ring 10 is prevented from leaking outside.

On the other hand, in the portion surrounding the flange portion 26 of the seal pipe 25 inserted into the portion on the outer circumferential side of the stationary blade 50, there is provided a stationary blade seal urging guide device 44, being disposed on an upper surface of the flange portion 26 of the seal pipe 25 so as to urge the flange portion 26 downwardly and supported to a fitting portion of the stationary blade 50 via a screw engagement 38*a*, 38*b*. Thus, a metal seal ring 70*c*, 70*d* disposed on a lower surface of the flange portion 26 is urged downwardly by the stationary blade seal urging guide device 44. By this seal structure, the steam in the cooling steam supply passage connection portion of the stationary blade 50 is prevented from leaking outside.

In operation of the prior art gas turbine, there are caused the rotor axial, radial and circumferential directional thermal deformations between the blade ring 10 and the stationary blade 50 and, in the cooling steam supply passage connection portion there, the blade ring 10 and the stationary blade 50 are fastened together by the bolt 41 at the shroud 42 and the metal seal ring 70*a*', 70*b*' is interposed on the lower surface of the flange portion 26 so as to effect a seal. Nevertheless, minute gaps arise due to the thermal deformation to cause steam leakage. But, by employing the above mentioned seal structure, the steam leakage in the cooling steam supply passage connection portion can be prevented, especially on the steam shield connection portion 21 side where there is provided the metal seal ring 70*a*, 70*b*.

Moreover, in the present embodiment, the gland packing 80*a*, 80*b* is provided surrounding the seal pipe 25 of the blade ring cooling steam supply passage 30 and, by this structure, a more secure seal is effected and steam leakage into the combustion gas can be prevented.

Figure 2:
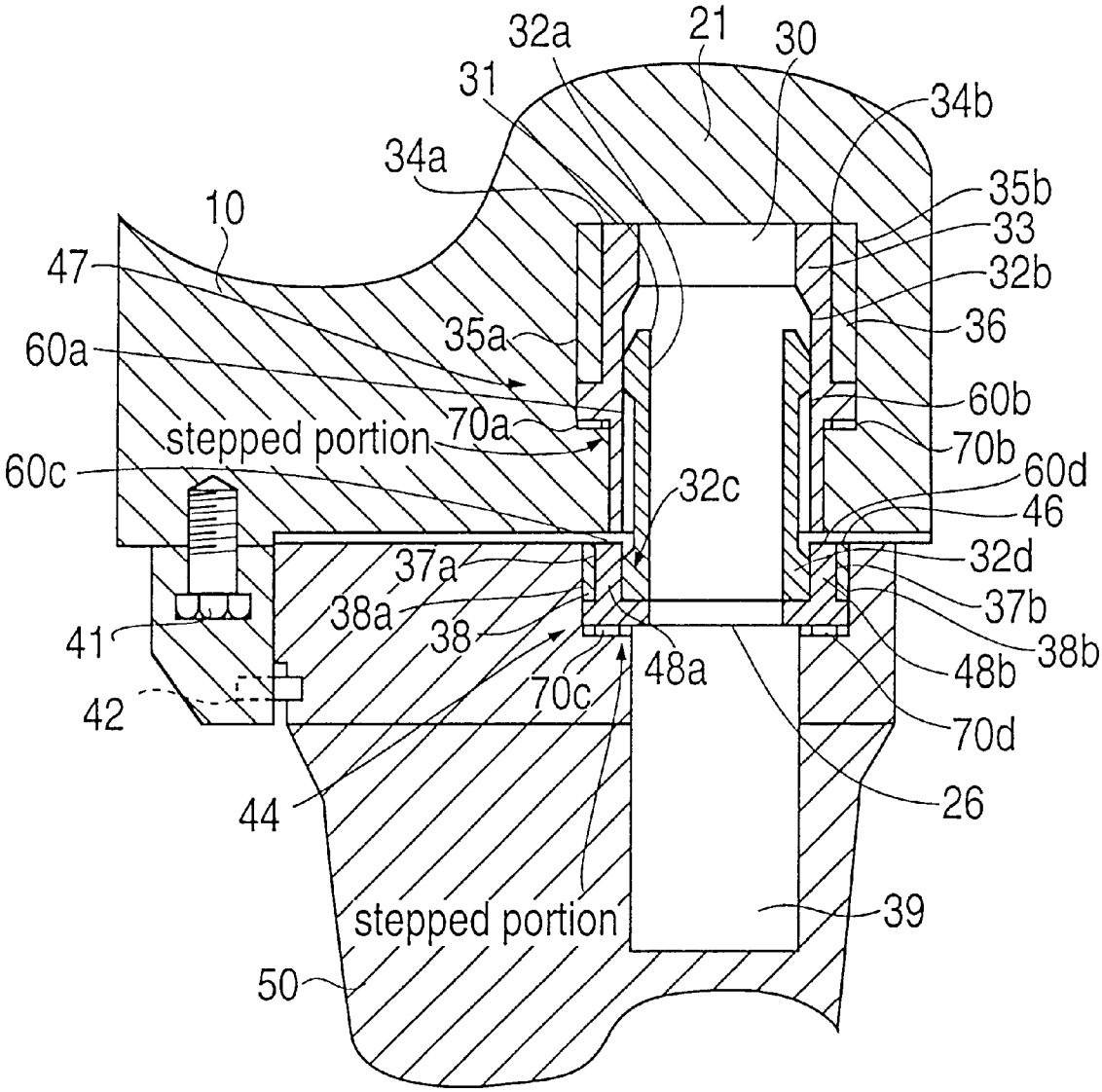
FIG. 2 is a view, in the same concept as FIG. 1, of a second embodiment according to the present invention.

FIG. 2 is a view, in the same concept as FIG. 1, of a second embodiment according to the present invention. In FIG. 2, like in the first embodiment shown in FIG. 1, a blade ring cooling steam supply passage 30 has its one end inserted into the blade ring steam passage hole provided on the inner circumferential side of the steam shield connection portion 21 and has the other end inserted into the stationary blade steam passage hole provided on the outer circumferential side of a stationary blade cooling steam supply passage 39. In the present embodiment, however, in the cooling steam supply passage connection portion between the blade ring 10 and the stationary blade 50, there are interposed first to fourth seal pipes 31, 33, 36, 46, as will be described below.

It is to be noted that a cooling steam return passage of the present second embodiment is structured, like in the first embodiment, in the substantially same way as the cooling steam supply passages 30, 39 of the present embodiment and description thereon will be omitted as being represented by the description of the cooling steam supply passages 30, 39.

In the seal structure of the second embodiment shown in FIG. 2, the cooling steam supply passage connection portion between the blade ring 10 and the stationary blade 50 is structured such that the portion inserted into the steam shield connection portion 21 comprises the first seal pipe 31 on the innermost circumferential side (in the rotor axial direction), the second seal pipe 33 in the middle portion and the third seal pipe 36 on the outermost side and the portion inserted into the outer circumferential side end portion of the stationary blade 50 comprises the first seal pipe 31 on the innermost side and the fourth seal pipe 46 in the middle portion, having an erecting portion 48*a*, 48*b* and a flange portion 26.

The first seal pipe 31 has at its upper end a swell portion 32*a*, 32*b* provided on an outer peripheral surface thereof and at its lower end likewise a swell portion 32*c*, 32*d*, so that an apex of the swell portion 32*a*, 32*b* makes contact with an inner surface of the second seal pipe 33 and an apex of the swell portion 32*c*, 32*d* with an inner surface of the erecting portion 48*a*, 48*b*. These contact surfaces are applied with a metal coating 60*a*, 60*b* and 60*c*, 60*d* of a material different from base metal of the blade ring 10. That is, more concretely, to the surface of stainless steel as the base metal of the blade ring 10, a high temperature slide coating containing Co, Ni or the like as a main component is applied. Thereby, an excellent contact ability between the contact surfaces is obtained, friction on the inner and outer surfaces of the second seal pipe 33 and the erecting portion 48*a*, 48*b* can be reduced and an effect to minimize abrasion due to the friction can be obtained.

Cooling steam is supplied from an outside steam supply source (not shown) to flow through the blade ring cooling steam supply passage 30 and the stationary blade cooling steam supply passage 39 and further through the cooling steam return passage provided in the blade ring 10 and the stationary blade 50. While the cooling steam so flows through these closed passages, the blade ring 10 and the stationary blade 50 are cooled and the cooling steam that is heated by cooling the blade ring 10 and the stationary blade 50 returns to be recovered into a steam turbine condenser or evaporator.

In operation of the gas turbine, while thermal deformations occur in the rotor axial, radial and circumferential directions in the blade ring 10 and the stationary blade 50, the cooling steam supply passage connection portion allows flexible contacts between the first seal pipe 31 and the second seal pipe 33 and between the first seal-pipe 31 and the erecting portion 48*a*, 48*b* of the fourth seal pipe 46. That is, while the first seal pipe 31 itself is a rigid body, the first seal pipe 31 makes contact with the inner surface of the second seal pipe 33 via the swell portion 32*a*, 32*b* and also makes contact with the erecting portion 48*a*, 48*b* via the swell portion 32*c*, 32*d*. Thus, by the round shape of the swell portions 32*a*, 32*b* and 32*c* 32*d*, flexible contacts can be effected relative to the rotor axial, radial and circumferential directional thermal deformations and thereby the thermal deformations can be well absorbed.

Also, there are provided a slidable contact 34*a*, 34*b* between the second seal pipe 33 and the third seal pipe 36 and a slidable contact 37*a*, 37*b* between the erecting portion 48*a*, 48*b* of the fourth seal pipe 46 and a screw member 38 as an independent member. Further, there are provided a screw engagement 35*a*, 35*b* between the third seal pipe 36 and the blade ring 10 and a screw engagement 38*a*, 38*b* between the screw member 38 and the stationary blade 50. Also, there are provided a projecting portion in the middle portion of the outer periphery of the second seal pipe 33 and a stepped portion of the corresponding position of the blade ring 10 and a stepped portion, below the flange portion 26, in the stationary blade 50. A metal seal ring 70*a*, 70*b* is interposed between the projecting portion of the second seal pipe 33 and the stepped portion of the blade ring 10 and a metal seal ring 70*c*, 70*d* is interposed between the lower surface of the flange portion 26 and the stepped portion of the stationary blade 50. In the above structure, a seal urging guide device 47 on the blade ring side is formed comprising the projecting portion of the second seal pipe 33 that abuts on the stepped portion of the blade ring 10 and the third seal pipe 36 that is supported to the blade ring 10 via the screw engagement 35*a*, 35*b* so as to generate an urging force to press the second seal pipe 33 downwardly. Also, a seal urging guide device 44 on the stationary blade side is formed comprising the fourth seal pipe 46 having the flange portion 26 and the screw member 38 that is supported at its outer circumferential surface to the stationary blade 50 via the screw engagement 38*a*, 38*b* so as to generate an urging force to press the fourth seal pipe 46 downwardly. Thus, by all these structures of the screw engagements and the metal seal rings as well as the slidable contacts, sealing ability at the operation time to cause the thermal deformation can be ensured and leakage of the steam is well prevented.

The second seal pipe has its upper inner circumferential surface provided with a tapered projecting portion so that the first seal pipe at its swell portion on the upper side may abut on this tapered projecting portion to be prevented from moving more upwardly.

As compared with the function and effect of the first embodiment, the present second embodiment is especially excellent in the easiness of assembly and disassembly of the seal structure comprising the seal pipes and metal seal rings for preventing the steam leakage. This point will be explained with reference to FIG. 2:

(a) First, to assemble the flange portion 26 into the outer circumferential side end portion of the fitting portion of the stationary blade 50.

(b) Next, to fasten the shroud 42 of the stationary blade 50, having the flange portion 26 so assembled, to the blade ring 10 by the bolt 41.

(c) Then, to insert the first seal pipe 31 into the blade ring steam passage hole from outside, that is, from the outer circumferential side, of the blade ring 10.

(d) Last, to insert the second pipe 33 around the first seal pipe 31 from above the first seal pipe 31.

That is, as shown in FIG. 2, the blade ring steam passage hole has its larger hole diameter portion on the outer circumferential side because of the shape of the seal structure. Hence, the first seal pipe 31 is inserted into the blade ring steam passage hole from the outer circumferential side of the blade ring 10 and then the second seal pipe 33 is inserted likewise from outside so that the seal structure is assembled in the blade ring steam passage hole at the position where the blade ring cooling steam supply passage 30 is to be arranged. By the abovementioned procedures, assembly and disassembly of the seal structure of the present embodiment can be done easily.

Also, as compared with the bellows type seal structure, as shown in FIGS. 3 to 6 and will be described below, in which the stationary blade 50 is first fitted to the blade ring 10 and then the seal structure is screwed from outside of the blade ring 10, the present second embodiment is still excellent in terms of assembly and disassembly of the seal structure.

It is to be noted that, while the slidable contact 34*a*, 34*b* between the second seal pipe 33 and the third seal pipe 36 and the slidable contact 37*a*, 37*b* between the erecting portion 48*a*, 48*b* of the fourth seal pipe 46 and the screw member 38 serve for sealing the steam as mentioned above, they also serve, together with the metal coatings 60*a*, 60*b* and 60*c*, 60*d*, for allowing thermal elongation and contraction of the first seal pipe 31.

Figure 3:
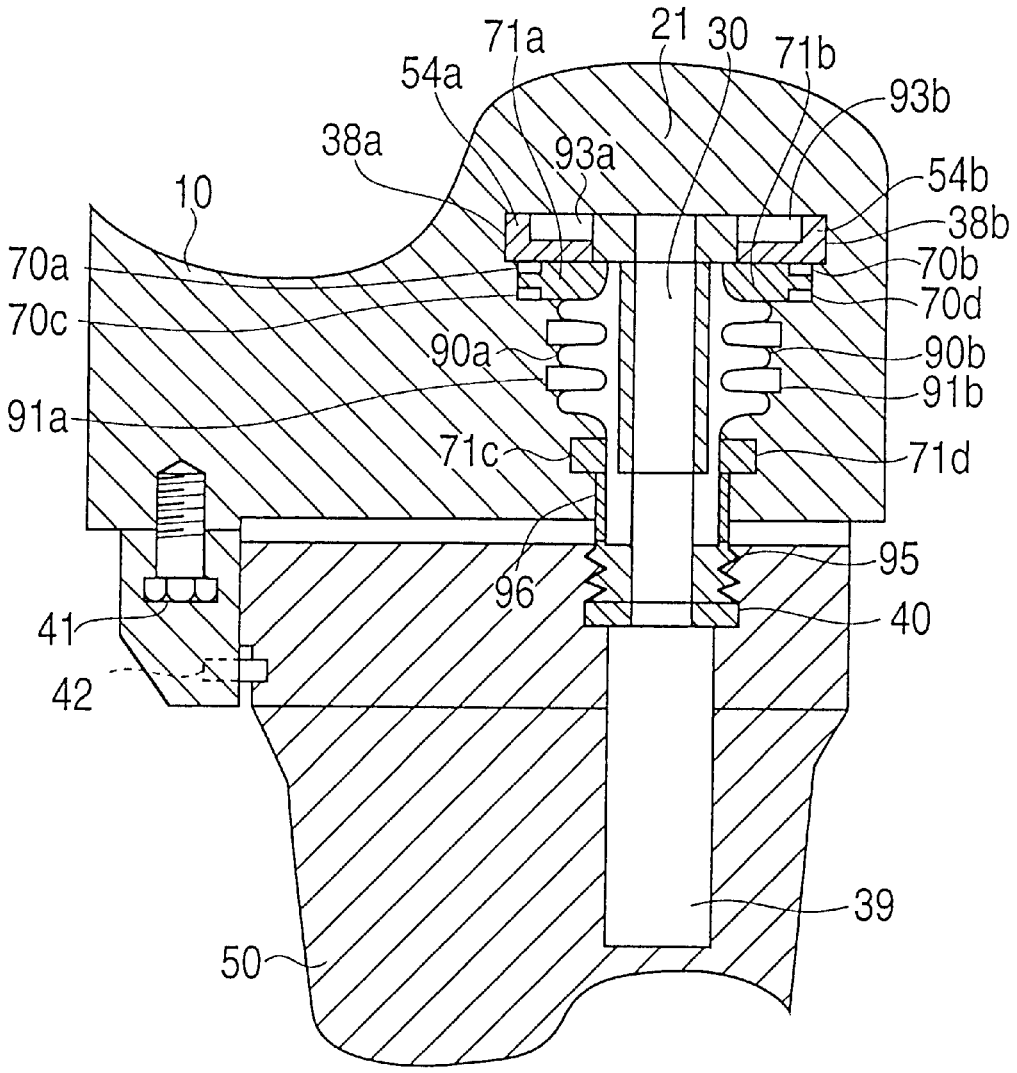
FIG. 3 is a view, in the same concept as FIG. 1, of a third embodiment according to the present invention.

FIG. 3 is a view, in the same concept as FIG. 1, of a third embodiment according to the present invention.

In FIG. 3, like in the first embodiment shown in FIG. 1, a blade ring cooling steam supply passage 30 has its one end inserted into the blade ring steam passage hole provided on the inner circumferential side of the steam shield connection portion 21 and has the other end inserted into the stationary blade steam passage hole provided on the outer circumferential side of a stationary blade cooling steam supply passage 39.

It is to be noted that a cooling steam return passage of the present third embodiment is structured, like in the first embodiment, in the substantially same way as the cooling steam supply passages 30, 39 of the present embodiment and description thereon will be omitted as being represented by the description of the cooling steam supply passages 30, 39.

As shown in FIG. 3, the blade ring cooling steam supply passage 30 is constructed comprising a hollow screw portion 95 provided on the inner circumferential side of the blade ring cooling steam supply passage 30 so as to be screwed into the fitting portion of the stationary blade 50, a cooling medium pipe 96 connected to the hollow screw portion 95 to be positioned in the blade ring 10 portion, a flange 71*c*, 71*d* connected to an upper end of the cooling medium pipe 96, a bellows member 90*a*, 90*b* connected to the flange 71*c*, 71*d* and a flange 71*a*, 71*b* connected to an upper end of the bellows member 90*a*, 90*b*. The bellows member 90*a*, 90*b* is elongatable and contractible up and down in the rotor radial direction and has a control ring 91*a*, 91*b* fitted into a recessed portion of an outer periphery of the bellows member 90*a*, 90*b* so as to stably support the bellows member 90*a*, 90*b*. The flange 71*a*, 71*b* has recessed portions at upper and lower corners of an outer circumferential peripheral portion thereof and metal seal rings 70*a*, 70*b* and 70*c*, 70*d* are fitted into the recessed portions of the flange 71*a*, 71*b*. A metal seal ring 40 is interposed between an end surface of the hollow screw portion 95 and an upper end surface of the stationary blade cooling steam supply passage 39.

In order to urge the flange 71*a*, 71*b* downwardly, an urging bolt 54*a*, 54*b*, having a groove 93*a*, 93*b*, for accepting a screwing jig, in an upper surface portion thereof, is provided so as to be screwed into the blade ring steam passage hole via a screw engagement 38*a*, 38*b*. By this urging structure as well as by the metal seal rings 70*a*, 70*b*, 70*c*, 70*d* and 40, steam as cooling medium is well sealed and leakage of the steam is prevented.

In operation of the gas turbine, while there are caused thermal deformations in the rotor axial, radial and circumferential directions in the blade ring 10 and the stationary blade 50, there is provided the seal pipe comprising the bellows member 90*a*, 90*b*, that is elongatable and contractible, and thereby the deformations are absorbed and leakage of the steam can be further prevented.

Figure 4:
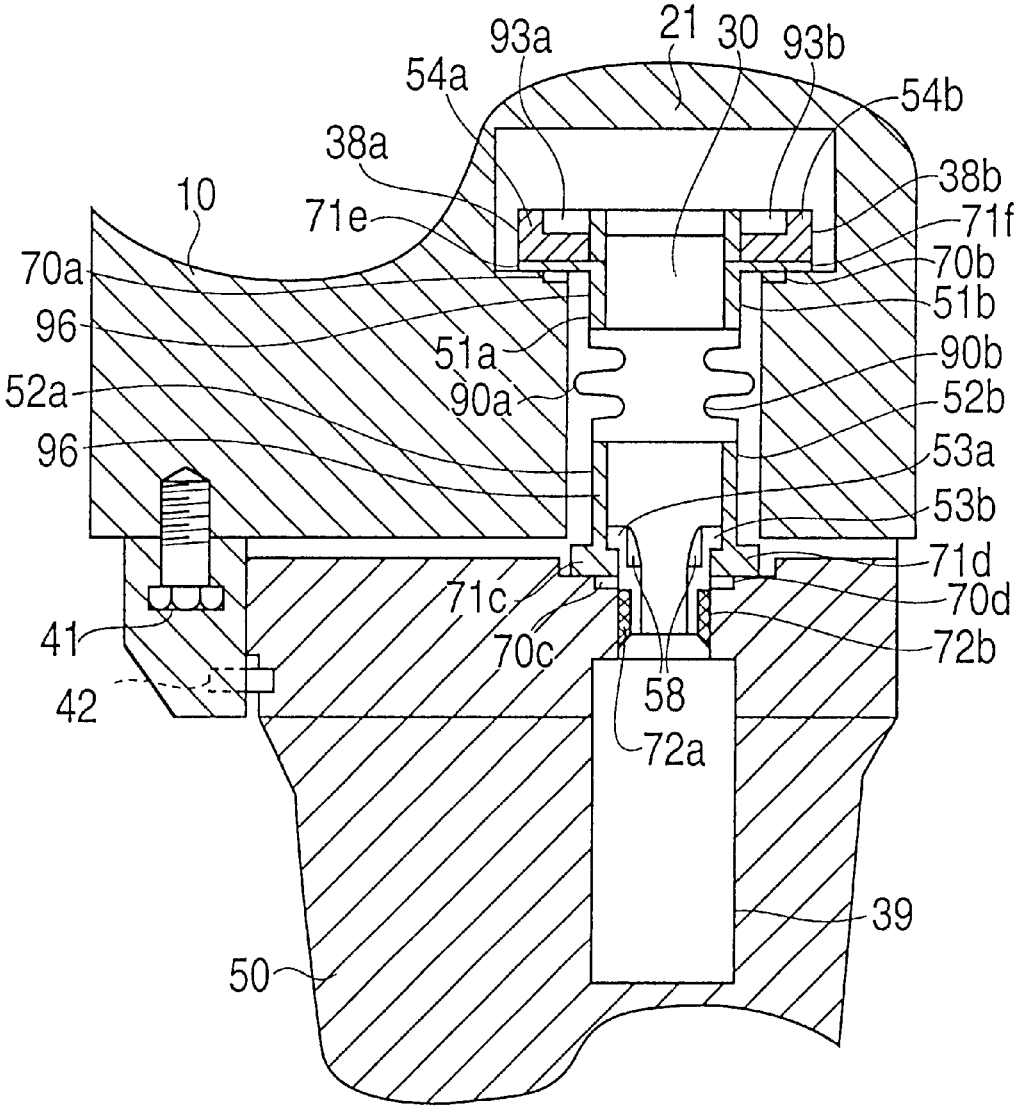
FIG. 4 is a view, in the same concept as FIG. 1, of a fourth embodiment according to the present invention.

FIG. 4 is a view, in the same concept as FIG. 1, of a fourth embodiment according to the present invention.

In FIG. 4, like in the first embodiment shown in FIG. 1, a blade ring cooling steam supply passage 30 has its one end inserted into the blade ring steam passage hole provided on the inner circumferential side of the steam shield connection portion 21 and has the other end inserted into the stationary blade steam passage hole provided on the outer circumferential side of a stationary blade cooling steam supply passage 39.

It is to be noted that a cooling steam return passage of the present fourth embodiment is structured, like in the first embodiment, in the substantially same way as the cooling steam supply passages 30, 39 of the present embodiment and description thereon will be omitted as being represented by the description of the cooling steam supply passages 30, 39.

As shown in FIG. 4, the blade ring cooling steam supply passage 30, at its portion on the inner circumferential side of the steam shield connection portion 21, comprises a cooling medium passage 96. The cooling medium passage 96 comprises, at its lower portion, a fifth seal pipe 52*a*, 52*b* having a flange 71*c*, 71*d*, at its middle portion, a bellows member 90*a*, 90*b* that is elongatable and contractible in the rotor radial direction and, at its upper portion, a sixth seal pipe 51*a*, 51*b* having a flange 71*e*, 71*f*. Also, the blade ring cooling steam supply passage 30, at its portion on the outer circumferential side of the stationary blade 50, comprises a first metal ring 53*a*, 53*b*, that is fitted to an interior of the stationary blade 50 via a screw engagement.

That is, numeral 72*a*, 72*b* designates a screw portion, and via this screw portion 72*a*, 72*b*, a lower end portion of the first metal ring 53*a*, 53*b* is screwed into an upper end portion of the stationary blade cooling steam supply passage 39.

Also, numeral 58 designates a narrow space, that is formed between a plurality of triangle plate members arranged in a cross shape, with their inclined sides opposing each other, in a stepped portion of an upper inner peripheral portion of the first metal ring 53*a*, 53*b*. When the first metal ring 53*a*, 53*b* of a cylindrical shape is to be screwed, a screwing jig is fitted into the space 58 for rotation of the first metal ring 53*a*, 53*b*.

A metal seal ring 70*c*, 70*d* is arranged between the stationary blade 50 and the flange 71*c*, 71*d* fixed to the lower portion of the fifth seal pipe 52*a*, 52*b*. The flange 71*c*, 71*d* together with the metal seal ring 70*c*, 70*d* functions to prevent the cooling medium from leaking from between the stationary blade 50 and the fifth seal pipe 52*a*, 52*b*.

Numeral 93*a*, 93*b* designates a groove, that is formed in an upper portion of the sixth seal pipe 51*a*, 51*b*, and numeral 54*a*, 54*b* designates an urging bolt for fixing the sixth seal pipe 51*a*, 51*b* to the blade ring 21. When the urging bolt 54*a*, 54*b* is to be screwed into the blade ring 10 via a screw engagement 38*a*, 38*b*, a screwing jig is fitted into the groove 93*a*, 93*b*.

A metal seal ring 70*a*, 70*b* is arranged between the blade ring 10 and the flange 71*e*, 71*f* of the sixth seal pipe 51*a*, 51*b*. When the urging bolt 54*a*, 54*b* is screwed into the blade ring 10, the metal seal ring 70*a*, 70*b* is pressed down via the flange 71*e*, 71*f* so that steam as the cooling medium is shielded to be prevented from leaking outside.

In operation of the gas turbine, while there are caused thermal deformations in the rotor axial, radial and circumferential directions in the blade ring 10 and the stationary blade 50, there is provided the bellows member 90*a*, 90*b*, that is elongatable and contractible, between the fifth seal pipe 52*a*, 52*b* and the sixth seal pipe 51*a*, 51*b* in the steam shield connection portion 21 and thereby the deformations are absorbed and leakage of the steam can be further securely prevented.

Figure 5:
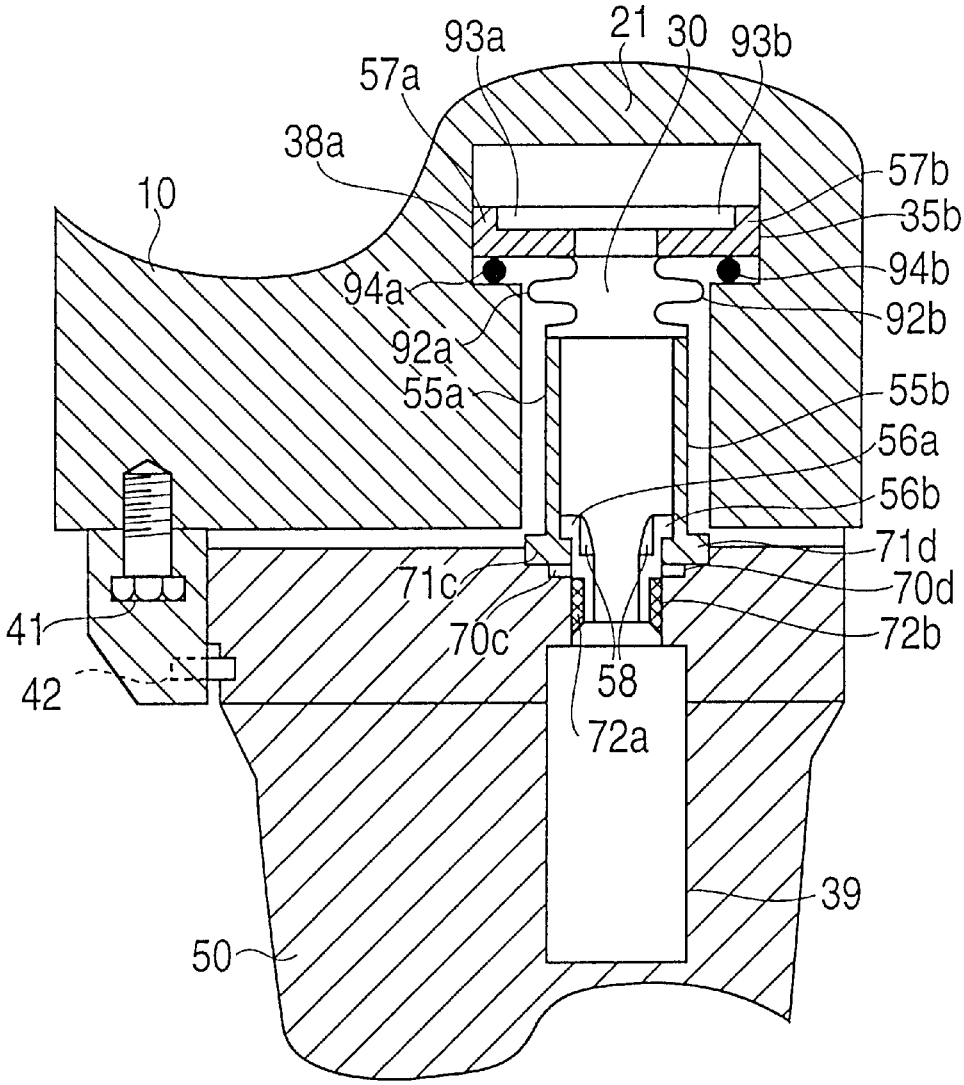
FIG. 5 is a view, in the same concept as FIG. 1, of a fifth embodiment according to the present invention.

FIG. 5 is a view, in the same concept as FIG. 1, of a fifth embodiment according to the present invention.

In FIG. 5, like in the first embodiment, a blade ring cooling steam supply passage 30 has its one end inserted into the blade ring steam passage hole provided on the inner circumferential side of the steam shield connection portion 21 and has the other end inserted into the stationary blade steam passage hole provided on the outer circumferential side of a stationary blade cooling steam supply passage 39.

It is to be noted that a cooling steam return passage of the present fifth embodiment is structured, like in the first embodiment, in the substantially same way as the cooling steam supply passages 30, 39 of the present embodiment and description thereon will be omitted as being represented by the description of the cooling steam supply passages 30, 39.

As shown in FIG. 5, the blade ring cooling steam supply passage 30, at its portion in the steam shield connection portion 21, comprises an eighth seal pipe 55*a*, 55*b* having a flange 71*c*, 71*d* at a lower portion and a bellows member 92*a*, 92*b*, that is elongatable and contractible in the rotor radial direction and is connected to an upper end of the eighth seal pipe 55*a*, 55*b*. On an inner circumferential surface of the lower end of the eighth seal pipe 55*a*, 55*b* in the portion of an upper end of the stationary blade 50, a third metal ring 56*a*, 56*b* is arranged so as to be screwed into the portion of an upper end of the stationary blade cooling steam supply passage 39 via a screw engagement 72*a*, 72*b*. A narrow space 58 for accepting a screwing jig is formed, in the same structure as in the fourth embodiment, in an upper end portion of the third metal ring 56*a*, 56*b*. By the screw engagement 72*a*, 72*b*, the eighth seal pipe 55*a*, 55*b* is supported to the stationary blade 50. A metal seal ring 70*a*, 70*b* is arranged between the eighth seal pipe 55*a*, 55*b* and the stationary blade 50 so that the cooling medium may be shielded. Further, a projecting member 94*a*, 94*b* having a circular cross sectional shape is fitted to an upper end the bellows member 92*a*, 92*b*.

On an upper end of the bellows member 92*a*, 92*b*, a fourth metal ring 57*a*, 57*b* is arranged so as to be screwed into the blade ring 10 via a screw engagement 35*a*, 35*b*. The fourth metal ring 57*a*, 57*b*, when it is screwed into the blade ring 10, pushes down the upper portion of the bellows member 92*a*, 92*b* so that a lower end of the projecting member 94*a*, 94*b* makes contact with a stepped portion provided in the blade ring 10. Thereby, the steam therearound as the cooling medium is shielded to be prevented from leaking outside. A groove 93*a*, 93*b* is provided in an upper portion of the fourth metal ring 57*a*, 57*b* so that a screwing jig may be fitted therein.

In operation of the gas turbine, while there are caused thermal deformations in the rotor axial, radial and circumferential directions in the blade ring 10 and the stationary blade 50, there are provided the structure of the eighth seal pipe 55*a*, 55*b*, the third metal ring 56*a*, 56*b* and the metal seal ring 70*c*, 70*d* as well as the structure of the bellows member 92*a*, 92*b*, the projecting member 94*a*, 94*b* and the fourth metal ring 57*a*, 57*b*, and thereby the deformations are absorbed by a flexible response of the bellows member 92*a*, 92*b* and leakage of the steam can be further securely prevented.

Also, according to the gas turbine having the seal structure of the present embodiment, even if a diameter of the eighth seal pipe 55*a*, 55*b* is enlarged, a countermeasure therefor can be taken easily.

Figure 6:
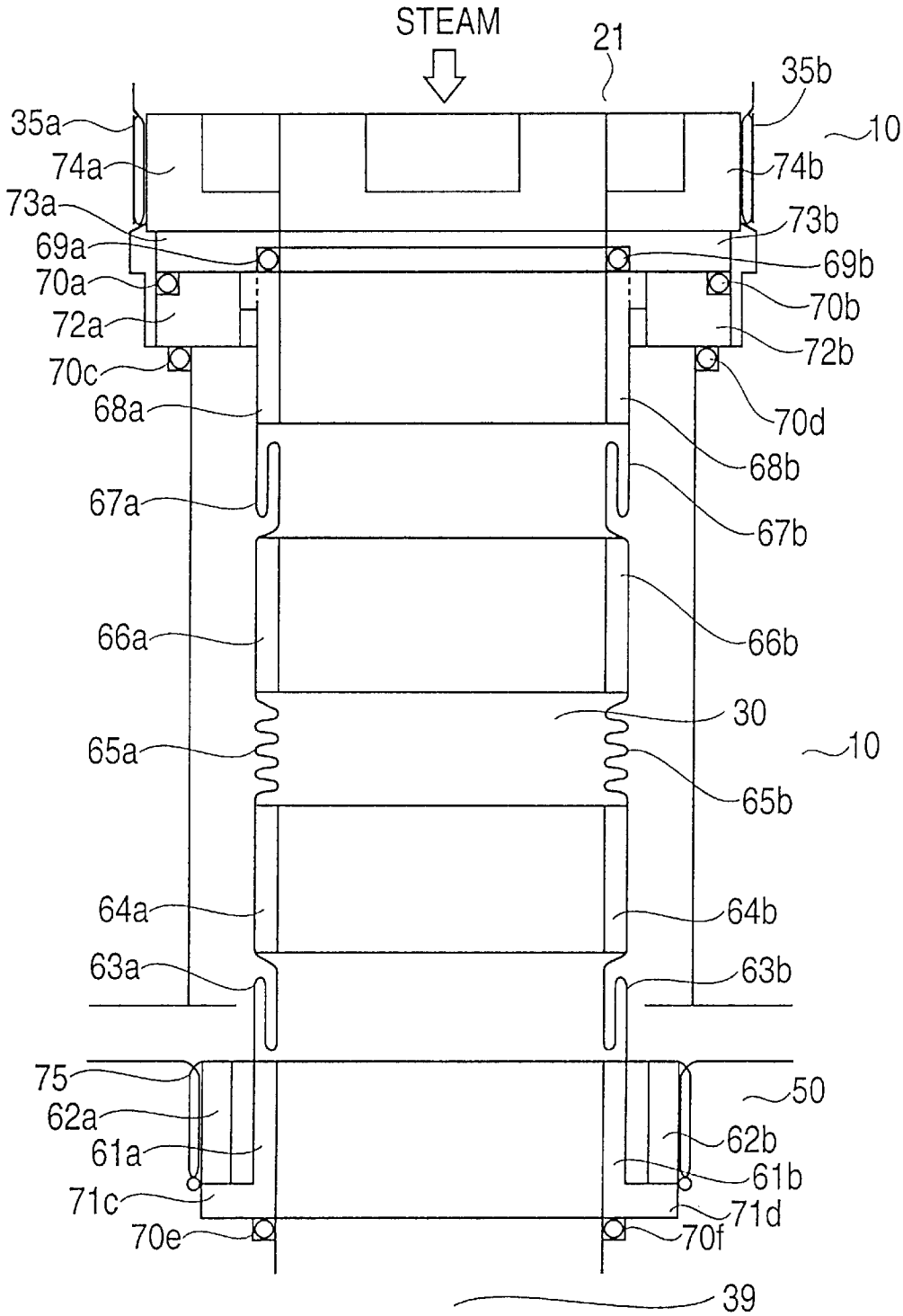
FIG. 6 is a cross sectional view of a blade ring cooling steam supply passage in a cooling steam supply passage connection portion between a blade ring and a stationary blade in a gas turbine of a sixth embodiment according to the present invention.

FIG. 6 is a cross sectional view of a blade ring cooling steam supply passage 30 in the cooling steam supply passage connection portion between the blade ring 10 and the stationary blade 50 in a gas turbine of a sixth embodiment according to the present invention. The blade ring cooling steam supply passage 30 has its one end inserted into the blade ring steam passage hole of the steam shield connection portion 21 of the blade ring 10 and has the other end inserted into the stationary blade steam passage hole of a stationary blade cooling steam supply passage 39 provided in the stationary blade 50.

It is to be noted that a cooling steam return passage of the present embodiment is structured, like in each of the above described embodiments, in the substantially same way as the cooling steam supply passages 30, 39 of the present embodiment and description thereon will be omitted as being represented by the description of the cooling steam supply passages 30, 39.

As shown in FIG. 6, in the portion of the stationary blade 50, the blade ring cooling steam supply passage 30 comprises a tenth seal pipe 61*a*, 61*b* having a flange 71*c*, 71*d*, a fifth metal ring 62*a*, 62*b* is screwed into the portion of the stationary blade 50 via a screw engagement 75 so as to fix the tenth seal pipe 61*a*, 61*b* via the flange 71*c*, 71*d*. A metal seal ring 70*e*, 70*f* is provided between the flange 71*c*, 71*d* and the stationary blade 50 so as to shield the cooling medium there. A bellows member 63*a*, 63*b*, that is elongatable and contractible in the rotor axial direction, has its one end connected to an upper end of the tenth seal pipe 61*a*, 61*b* and has the other end connected to a lower end of an eleventh seal pipe 64*a*, 64*b*, that is provided above the tenth seal pipe 61*a*, 61*b*.

In the portion of the blade ring 10, the blade ring cooling steam supply passage 30 comprises, at its lower portion, the eleventh seal pipe 64*a*, 64*b*, at its middle portion, a twelfth seal pipe 66*a*, 66*b* and at its upper portion, a thirteenth seal pipe 68*a*, 68*b*. A bellows member 65*a*, 65*b*, that is elongatable and contractible in the rotor radial direction, is provided between the eleventh and twelfth seal pipes 64*a*, 64*b* and 66*a*, 66*b*, having its one end connected to an upper end of the eleventh seal pipe 64*a*, 64*b* and the other end connected to a lower end of the twelfth seal pipe 66*a*, 66*b*. Also, a bellows member 67*a*, 67*b*, that is elongatable and contractible in the rotor axial direction, is provided between the twelfth and thirteenth seal pipes 66*a*, 66*b* and 68*a*, 68*b*, having its one end connected to an upper end of the twelfth seal pipe 66*a*, 66*b* and the other end connected to a lower end of the thirteenth seal pipe 68*a*, 68*b*.

Around an upper portion of the thirteenth seal pipe 68*a*, 68*b*, a screw member 72*a*, 72*b* is arranged, being fixed to the blade ring 10 via a screw engagement so as to press down a metal seal ring 70*c*, 70*d* that is disposed between the screw member 72*a*, 72*b* and the blade ring 10. A recessed portion is provided in an upper corner portion of the screw member 72*a*, 72*b* and a metal seal ring 70*a*, 70*b* is disposed therein. A seventh metal ring 73*a*, 73*b* is arranged on the screw member 72*a*, 72*b* and, on an inner diameter side of the seventh metal ring 73*a*, 73*b*, a metal seal ring 69*a*, 69*b* is disposed. An eighth metal ring 74*a*, 74*b* is arranged on the seventh metal ring 73*a*, being fixed to the blade ring 10 via a screw engagement 35*a*, 35*b* so as to press the seventh metal ring 73*a*, 73*b* downwardly. Thereby, both the metal seal rings 69*a*, 69*b* and 70*a*, 70*b* are pressed and steam as the cooling medium is shielded to be prevented from leaking outside.

In operation of the gas turbine, while there are caused the rotor axial, radial and circumferential directional thermal deformations, there are provided the eleventh, twelfth and thirteenth seal pipes 64*a*, 64*b*, 66*a*, 66*b* and 68*a*, 68*b* as well as the bellows members 63*a*, 63*b*, 65*a*, 65*b* and 67*a*, 67*b*. Thereby, the deformations in the rotor radial and circumferential directions are absorbed by the bellows member 65*a*, 65*b* that is elongatable and contractible in the rotor axial direction and the deformation in the rotor axial direction is absorbed by the bellows members 63*a*, 63*b* and 67*a*, 67*b* that are elongatable and contractible in the rotor axial direction. Also, the steam as the cooling medium can be prevented from leaking outside.

While the preferred forms of the present invention have been described, it is to be understood that the seal structure of the steam passages between the blade ring and the stationary blade of the gas turbine according to the present invention is not limited to the particular constructions and arrangements herein illustrated and described but embraces such modified forms thereof as come within the scope of the appended claims.

What is claimed is:

1. A gas turbine steam passage seal structure between a blade ring and a stationary blade, comprising:

a blade ring steam passage hole provided in the blade ring so as to have its one end communicated with a steam passage chamber of the blade ring, the blade ring steam passage hole having a stepped portion formed in a middle portion thereof;

a stationary blade steam passage hole provided in the stationary blade so as to oppose the other end of the blade ring steam passage hole, the stationary blade steam passage hole having a stepped portion formed in a stationary blade outer peripheral portion thereof; and a cooling steam supply passage connection portion constructed comprising a seal pipe of a hollow cylindrical shape provided between the blade ring steam passage hole and the stationary blade steam passage hole so as to communicate them with each other and a seal urging guide device provided at each of the stepped portions of the blade ring steam passage hole and the stationary blade steam passage hole so as to effect a seal of the cooling steam supply passage connection portion while fixedly supporting the seal pipe.

2. A gas turbine steam passage seal structure, wherein, in addition to the gas turbine steam passage seal structure of claim 1 applied to a cooling steam supply passage, the same seal structure is also applied to a cooling steam return passage.

3. A gas turbine steam passage seal structure as claimed in claim 1, wherein a metal seal ring is interposed between the seal urging guide device and at least one of the stepped portions of the blade ring steam passage hole and the stationary blade steam passage hole.

4. A gas turbine steam passage seal structure as claimed in claim 1, wherein the seal pipe has its lower end provided with a flange portion and the flange portion is fixedly supported to the stepped portion of the stationary blade steam passage hole by an urging force of the seal urging guide device provided in the stationary blade steam passage hole.

5. A gas turbine steam passage seal structure as claimed in claim 4, wherein a gland packing case is fitted into the blade ring steam passage hole and a gland packing is interposed between the seal pipe and the gland packing case.

6. A gas turbine steam passage seal structure as claimed in claim 1, wherein the cooling steam supply passage connection portion is constructed comprising a first seal pipe provided between the blade ring steam passage hole and the stationary blade steam passage hole so as to communicate them with each other, a second seal pipe and a third seal pipe both provided in the blade ring steam passage hole and a fourth seal pipe provided in the stationary blade steam passage hole, the first seal pipe having at its outer circumferential upper and lower surfaces swell portions, the swell portion on the upper side making a slidable contact with an inner circumferential surface of the second seal pipe, the swell portion on the lower side making a slidable contact with an inner circumferential surface of the fourth seal pipe, the second seal pipe having on its outer circumferential surface a projecting portion that abuts on the stepped portion of the blade ring steam passage hole, the third seal pipe being supported at its outer circumferential surface to the blade ring steam passage hole via a screw engagement and making at its inner circumferential surface a slidable contact with an outer circumferential surface of the second seal pipe, the fourth seal pipe having at its lower end a flange portion.

7. A gas turbine steam passage seal structure as claimed in claim 6, wherein the second seal pipe has its upper inner circumferential surface provided with a tapered projecting portion so that the first seal pipe at its swell portion on the upper side may abut on the tapered projecting portion to be prevented from moving more upwardly.

8. A gas turbine steam passage seal structure as claimed in claim 6, wherein the seal urging guide device of the blade ring steam passage hole is formed comprising the projecting portion of the second seal pipe that abuts on the stepped portion of the blade ring steam passage hole and the third seal pipe that is supported to the blade ring steam passage hole via the screw engagement so as to generate an urging force to press the second seal pipe downwardly.

9. A gas turbine steam passage seal structure as claimed in claim 6, wherein the seal urging guide device of the stationary blade steam passage hole is formed comprising the fourth seal pipe having the flange portion and a screw member as an independent member that is supported at its outer circumferential surface to the stationary blade steam passage hole via a screw engagement so as to generate an urging force to press the fourth seal pipe downwardly and makes at its inner circumferential surface a slidable contact with an outer circumferential surface of the fourth seal pipe.

10. A gas turbine steam passage seal structure as claimed in claim 1, wherein the cooling steam supply passage connection portion at its portion provided in the blade ring steam passage hole is constructed comprising a bellows member that is elongatable and contractible in the rotor radial direction and a control ring that is fitted into a recessed portion of an outer periphery of the bellows member so as to stably support the bellows member.

11. A gas turbine steam passage seal structure as claimed in claim 1, wherein the cooling steam supply passage connection portion at its portion provided in the blade ring steam passage hole is constructed comprising seal pipes provided at upper and lower ends thereof and a bellows member, provided therebetween, that is elongatable and contractible in the rotor radial direction.

12. A gas turbine steam passage seal structure as claimed in claim 1, wherein the cooling steam supply passage connection portion is constructed comprising a seal pipe and a bellows member connected to each other, the bellows member being elongatable and contractible in the rotor radial direction.

13. A gas turbine steam passage seal structure as claimed in claim 1, wherein the cooling steam supply passage connection portion is constructed comprising a plurality of seal pipes, a bellows member, that is elongatable and contractible in the rotor radial direction and is interposed between adjacent ones of the plurality of seal pipes and a bellows member, that is elongatable and contractible in the rotor axial direction and is interposed between other adjacent ones of the plurality of seal pipes.

* * * * *